US009010129B2

(12) United States Patent
Lilke

(10) Patent No.: US 9,010,129 B2
(45) Date of Patent: Apr. 21, 2015

(54) THERMOELECTRIC COOLING SYSTEMS AND ENGINES

(76) Inventor: Harvey D. Lilke, Winnipeg (CA)

( * ) Notice: Subject to any disclaimer, the term of this patent is extended or adjusted under 35 U.S.C. 154(b) by 687 days.

(21) Appl. No.: 13/264,839

(22) PCT Filed: May 26, 2010

(86) PCT No.: PCT/CA2010/000766

§ 371 (c)(1),
(2), (4) Date: Oct. 17, 2011

(87) PCT Pub. No.: WO2010/135815

PCT Pub. Date: Dec. 2, 2010

(65) Prior Publication Data

US 2012/0055170 A1 Mar. 8, 2012

Related U.S. Application Data

(60) Provisional application No. 61/181,094, filed on May 26, 2009.

(51) Int. Cl.

| | |
|---|---|
| ***F25B 21/02*** | (2006.01) |
| ***F24F 5/00*** | (2006.01) |
| ***F24H 3/04*** | (2006.01) |

(52) U.S. Cl.

CPC ..... *F24F 5/0042* (2013.01); *F24H 3/0411* (2013.01); *F24H 2250/04* (2013.01); *F25B 21/02* (2013.01); *F25B 2321/0251* (2013.01); *F25D 2317/0684* (2013.01)

(58) Field of Classification Search

USPC ..... 62/3.6, 3.2, 259.2, 408

See application file for complete search history.

(56) References Cited

U.S. PATENT DOCUMENTS

2008/0163628 A1* 7/2008 Lilke ..... 62/3.6

* cited by examiner

*Primary Examiner* — Cassey D Bauer

(74) *Attorney, Agent, or Firm* — Kyle R. Satterthwaite; Ryan W. Dupuis; Ade & Company Inc.

(57) ABSTRACT

A space efficient system especially suited for use as an entirely self-contained stand-alone unit usable in any of multiple contexts where heating or cooling of a defined-volume or enclosure is required. Hot or cold sides of the thermoelectric assemblies face toward one another into a central airflow that enters and exits a housing through a top or bottom of the housing that faces into the enclosure, and the opposite sides of the thermoelectric modules face into channels on opposite sides of the central airflow. The channels can be connected to intake and exhaust air through a common end of the housing, or be separated to individually intake and exhaust air at opposing ends of the housing. Fastener-free mounting of components between insulation shells that cooperate with the thermoelectric assemblies to define the channel boundaries results in tool-free configurability of components for servicing, maintaining, reconfiguring, scaling or customizing of the system.

18 Claims, 9 Drawing Sheets

THERMOELECTRIC COOLING SYSTEMS AND ENGINES

This application claims the benefits under 35 U.S.C. 119(e) of U.S. provisional application Ser. No. 61/181,094, filed May 26, 2009.

FIELD OF THE INVENTION

The present invention relates generally to thermoelectric heating or cooling systems, and more particularly to such self contained stand alone cooling systems that may be employed for heating or cooling of any of a number of different enclosures.

BACKGROUND OF THE INVENTION

Applicant's U.S. Pat. No. 7,596,956, herein incorporated by reference, teaches a self-contained cooling system (SCCS) slide-in module featuring a housing that contains a single thermoelectric cooling assembly supported therein to dispose the hot and cold sides of the thermoelectric cooling assembly in opposite ones of two separated chambers within the housing's interior. The hot side chamber is communicated with the housing exterior by inlet and outlet openings in a front end face of the SCCS module housing, while the cold side chamber is communicated with the housing exterior at a top or bottom panel of the housing. Placed at the bottom or top of a cabinet so that the hot side chamber is communicated with the ambient environment outside the cabinet through an open portion of the cabinet's front face below or above the cabinet door, the air inside the cabinet is cooled by exposure to the cold side of the thermoelectric cooling assembly and ambient air is drawn into the housing through the inlet openings in the front face to draw heat from the hot side and subsequently exhaust this heated air back through the front face at the outlet openings.

It would be desirable to increase the cooling effect of the cooling module by adding at least one additional thermoelectric cooling assembly to the cooling system without having to effectively double the overall size of the cooling module to accommodate the greater intake of ambient air needed to effect the cooling of the increased number of thermoelectric cooling assemblies used in the system.

U.S. Pat. Nos. 5,385,020 and 6,959,555 teach thermoelectric systems in which multiple thermoelectric modules are employed to expose their corresponding sides to a common airflow to increase a heating or cooling effect on that airflow. However, the systems laid out in these references are not configured for optimal use as non-integral, removable, standalone devices that can be easy added to any enclosure to provide a heating or cooling function therein.

Applicant has now developed improved thermoelectric heating or cooling systems that accommodate multiple thermoelectric cooling assemblies in a space efficient manner, and unique thermoelectric engine designs stemming from development of these cooling systems.

SUMMARY OF THE INVENTION

According to a first aspect of the invention there is provided a heating or cooling unit for heating or cooling an enclosure, the unit comprising:

a housing having an interior bound by opposing first and second end faces, opposing first and second side walls and opposing top and bottom panels;

three flow channels defined within an interior of the housing and consisting of first and second outer flow channels extending along the opposing first and second sides on opposite sides of a center flow channel that is closed off from the outer flow channels;

first and second thermoelectric modules supported at boundaries between the center flow channel and the first and second outer flow channels respectively with matching ones of a hot or cold side of each of the first and second thermoelectric modules facing into the first and second outer flow channels respectively and the other of the or cold side of each of the thermoelectric modules facing into the center flow channel;

center inlet and outlet openings in a same one of the top and bottom panels, the center inlet and outlet openings being situated at the center flow channel and communicating an exterior of the housing with only the center flow channel of the three flow channels; and outer inlet and outlet openings in one or opposing ones of the first and second end faces, the outer inlet and outlet openings being situated at the outer flow channels, communicating the exterior of the housing with only the outer flow channels of the three flow channels, and comprising at least first and second outer openings in the front end face at the first and second outer channels respectively.

The outer inlet and outlet openings may consist only of the first and second outer openings, with the first and second outer channels being interconnected around the center channel between the center channel and the rear end face.

Alternatively, each of the outer channels may openable and closable to the exterior of the housing at the rear end face to selectively define outer outlet openings when open at the rear end face for air flow through each end face at each channel. With each outer channel closed at the rear end face, the outer channels are interconnected with one another around the center channel for airflow into the first outer channel through the first outer opening in front end face, onward from the first channel into the second channel through interconnection of the outer channels sections around the center channel, and then out from the second outer channel through the second outer opening. There may be provided two rear end panels swappable for one another in a position defining the rear end face of the housing, only one the two swappable rear end panels having openings therein aligning with the outer channels when installed to define the outer outlet openings at the rear end face. There may be provided first and second outer fans installed within the first and second outer channels respectively to convey air therealong, with at least one of the first and second outer fans being reversible to change a direction in which air is conveyed thereby to enable air conveyance of the first and second outer fans in a same direction with the outer channels closed to the exterior of the housing at the rear end face thereof and in opposite directions with the outer channels open to the exterior of the housing at the rear end face thereof.

There is preferably provided internal insulation in the interior of the housing, the internal insulation cooperating with thermoelectric assemblies featuring the thermoelectric modules to define the boundaries between the central channel and the outer channel and provide thermal insulation and vapor seal therebetween.

The internal insulation preferably defines module seats that conform in shape to the thermoelectric modules to for receipt and positioning thereof at the boundaries between the central channel and the outer channel.

The internal insulation preferably comprises insulation pieces mated together with the thermoelectric modules sandwiched there between.

Preferably the thermoelectric modules are positively positioned within the interior of the housing by the module seats in a fastener-free installation of the thermoelectric modules.

Preferably the insulation pieces comprise top and bottom shell pieces mated together from above and below the thermoelectric modules, at least one of the top and bottom panels being removable with a respective one of the top and bottom shell pieces to access the thermoelectric modules. Preferably the top and bottom insulation pieces at the fitting together thereof overlap in a direction crossing between adjacent channels.

The internal insulation also preferably defines at least one fan seat that conforms in shape to at least one fan and receives and positions said at least one fan in a position to convey air along at least one of the channels.

Preferably the position of each said at least one fan is accessible for retrieval thereof the interior of the housing by removal of a respective one of the walls, panels or end faces without requiring removal of any of the internal insulation.

Each fan seat may be dimensioned to accommodate multiple box fans in an axially aligned face-to-face stacked configuration, whereby a user can add and remove fans to the fan seat as required to control air flow.

The at least one fan seat may comprise a rear fan seat positioned within an interconnection of the outer flow channels around the center flow channel.

Preferably there is provided at least one wick extending from inside the central channel into at least one of the outer channels to draw moisture condensed from exposure of air to heat exchange with the cold side of at least one of the thermoelectric modules to an area exposed to heat exchange with the hot side of said thermoelectric module.

Preferably the at least one wick extends into both of the outer channels from the center channel.

There may be provided at least one fan positioned in a respective one of the one of the outer channels adjacent the front end face, in which case there is preferably at least one respective filtering muffler disposed between said at least one fan and said front end face. In this instance, there is preferably provided a slot in a respective side of the front end face through which the at least one filtering muffler is removable.

In embodiments featuring an interconnection of the first and second outer channels around the center channel between the rear end face and the center channel, there may be provided at least one fan mounted in the interconnection of the outer channels and operable to convey air from one of said outer channels to the other.

According to a second aspect of the invention there is provided a cooling system comprising:

a housing having opposing first and second ends and opposing first and second sides extending between the opposing first and second ends;

three flow channels defined within an interior of the housing and consisting of first and second outer flow channels extending along the opposing first and second sides on opposite sides of a center flow channel closed off from the outer flow channels;

first and second thermoelectric modules supported at boundaries between the center flow channel and the first and second outer flow channels with hot sides of the first and second thermoelectric modules facing into the first and second outer flow channels respectively and cold sides of the first and second thermoelectric modules both facing into the center flow channel;

center inlet and outlet openings situated at the center flow channel and communicating an exterior of the housing with only the center flow channel of the three flow channels; and outer inlet and outlet openings situated at the outer flow channels and communicating the exterior of the housing with only the outer flow channels of the three flow channels.

The outside inlet and outlet openings may comprise a first set of outer openings situated at the first end of the housing and a second set of outer openings situated at the second end of the housing. In one such instance, the first and second outside flow channels may be permanently closed off from one another. In another instance, the second pair of outer openings may be selectively closeable and the first and second outer flow channels selectively openable to one another.

In embodiments where the second pair of outer openings are selectively closeable, the first hot side fan may be operable to move air along the first outer flow channel from the first set of outer openings toward the second set of outer openings and an airflow direction of the second hot side fan being changeable between an intake direction causing air to move along the second outer flow channel from the first set of outer openings toward the second set of outer openings and an exhaust direction causing air to move along the second outer flow channel toward the first set of outer openings.

Where the first and second outer flow channels are open to one another and the outer inlet and outlet openings are open only at the first end of the housing, the outer inlet and outlet openings define an outer inlet opening situated at the first outer flow channel and an outer outlet opening situated at the second outer flow channel and at least one hot side fan is in communication with the first and second outer channels and operable to move air through the first and second outer channels from the outer inlet opening to the outer outlet opening.

Where the first and second outer flow channels are open to one another, preferably the center flow channel extends less than a full length of the housing between the opposing ends thereof and the first and second outer flow channels communicate with one another between the second end of the housing and an end of the thermoelectric modules nearest thereto.

There may be provided first and second hot side fans in communication with the first and second outer channels respectively and operable to move air through the first and second outer channels respectively.

There may be provided a cold side fan in communication with the center flow channel and operable to move air through the center flow channel between the center inlet and outlet openings.

The center inlet and outlet openings are preferably provided in a cover spanning across the center flow channel between the boundaries between the center flow channel and the outer flow channels.

The center inlet and outlet openings are preferably respectively situated past a common end of the thermoelectric modules between the thermoelectric modules and a respective end of the housing.

The cover preferably spans fully across the housing between the first and second sides thereof to cover the three flow channels.

Corners of the housing at connection of the opposing sides to the second end may be internally radiused.

There is preferably provided a hot side heat sink on the hot side of each thermoelectric module.

There is preferably provided a cold side sink on the cold side of each thermoelectric module.

Each cold side sink may comprise a pin type sink.

There may be provided an airflow shroud containing the cold side sinks and smoothly curving away from the center inlet openings toward the center outlet openings to guide airflow there between.

The first thermoelectric module may be part of a first thermoelectric assembly comprising a first plurality thermoelectric modules having hot and cold sides thereof facing into the first outer channel and center channel respectively, with the second thermoelectric module being part of a second thermoelectric assembly comprising a second plurality thermoelectric modules having hot and cold sides thereof facing into the second outer channel and center channel respectively.

The first thermoelectric assembly may further comprise a first hot side sink and a first cold side sink fixed to the hot and cold sides of the first plurality of thermoelectric modules, with the second thermoelectric assembly likewise further comprising a second hot side sink and a second cold side sink fixed to the hot and cold sides of the second plurality of thermoelectric modules.

The first and second thermoelectric assemblies may be interconnected by a cold side fan housing spanning therebetween and carrying a fan operable to move air along the first and second thermoelectric assemblies between the first and second cold side sinks.

According to a third aspect of the invention there is provided a thermoelectric heating or cooling unit comprising:

a housing having an interior bound in part by opposing first and second panels, the interior being divided into at least first and second airflow channels that are adjacent one another and that separately communicate with an exterior of the housing to enable separate airflows through the interior of the housing;

first and second insulation pieces fitted together inside the housing and having respective base portions lying respectively adjacent the first and second panels of the housing within the interior thereof, the two base portions being spaced apart from one another and respectively defining opposing first and second boundaries of each of the airflow channels, at least one of the insulation pieces having projecting portions thereof projecting away from the base portion thereof toward the base portion of the other insulation piece to fit against mating features on the other insulation piece; and a thermoelectric assembly comprising a thermoelectric module with a hot side and a cold side facing into opposite ones of the first and second airflow channels, the thermoelectric assembly cooperating with the fitting together of the insulation pieces at the projecting portions and mating features to form a boundary wall between the first and second airflow channels.

Preferably the thermoelectric assembly is retained in place within the interior of the housing by a fastener-free friction fit with the insulation pieces.

Preferably the first and second panels adjacent which the base portions of the insulation pieces lie define a majority of a surface area of the housing.

Preferably the insulation pieces overlap in a direction crossing between the adjacent airflow channels at the fitting together of the insulation pieces.

Preferably the thermoelectric assembly is sandwiched between the two insulation pieces.

Preferably the first panel and the first insulation piece are removable and the thermoelectric assembly is accessible and removable by removal of the first panel and first insulation.

Preferably there is provided a fan positioned in one of the airflow channels and held in place by the insulation pieces.

Preferably the fan is accessible from outside the housing by removal of an outer panel thereof without removal of either insulation piece.

Preferably the fan is sandwiched between the insulation pieces adjacent corresponding perimeter edges thereof.

According to a fourth aspect of the invention there is provided a heating or cooing unit comprising:

a housing having an interior space divided into at least two separate passages each having an inlet and an outlet communicating with an exterior of the housing to enable airflow through the housing via said passage;

internal insulation within the interior space of the housing; and one or more electrical components including a thermoelectric assembly comprising a thermoelectric module having hot and cold sides facing into opposite ones of adjacent separate passages;

at least one of said electrical components being held in place within the interior space of the housing by frictional engagement with the internal insulation.

Preferably the one or more electrical components further comprises a fan operable convey air within one of the passages and held in place by said frictional engagement.

Preferably the thermoelectric assembly is held in place by said frictional engagement.

Preferably said frictional engagement comprises sandwiching of said at least one electrical component between two pieces of insulation.

Preferably said at least one electrical component is held in place solely by said frictional engagement in a fastener-free installation.

According to a fifth aspect of the invention there is provided a thermoelectric engine comprising:

a thermoelectric assembly comprising:

a thermoelectric module having a hot side and a cold side;

a hot side heat sink mounted to the hot side of the thermoelectric module; and a cold side sink mounted to the cold side of the thermoelectric module; and a fan housing secured to the thermoelectric assembly and projecting away therefrom on one side thereof for rotation about an axis extending along the thermoelectric cooling assembly.

There may be provided an additional thermoelectric cooling assembly secured to the fan housing on a side thereof opposite the thermoelectric assembly with same ones of a hot or cold side of each thermoelectric assembly facing together.

The thermoelectric assembly may comprise multiple thermoelectric modules arranged parallel and facing a common direction with the hot side heat sink mounted to hot sides of the multiple thermoelectric modules and the cold side sink mounted to cold sides of the multiple thermoelectric modules.

The fan may project away from the thermoelectric cooling assembly on the cold side thereof.

The heating or cooling units of the present invention may comprise an electrical connector accessible at an exterior of the housing and arranged to couple with a mating electrical connector of an auxiliary exterior fan outside the housing to enable operation of the fan within a space in which the heating or cooling unit is installed to promote flow of air within the space to increase exposure of the air to the thermoelectric assemblies.

The heating or cooling units of the present invention may comprise a light source carried on the housing and operable to provide illumination at the exterior thereof to illuminate a space in which the heating or cooling unit is installed.

BRIEF DESCRIPTION OF THE DRAWINGS

In the accompanying drawings, which illustrate exemplary embodiments of the present invention.

DETAILED DESCRIPTION

Figure 1:
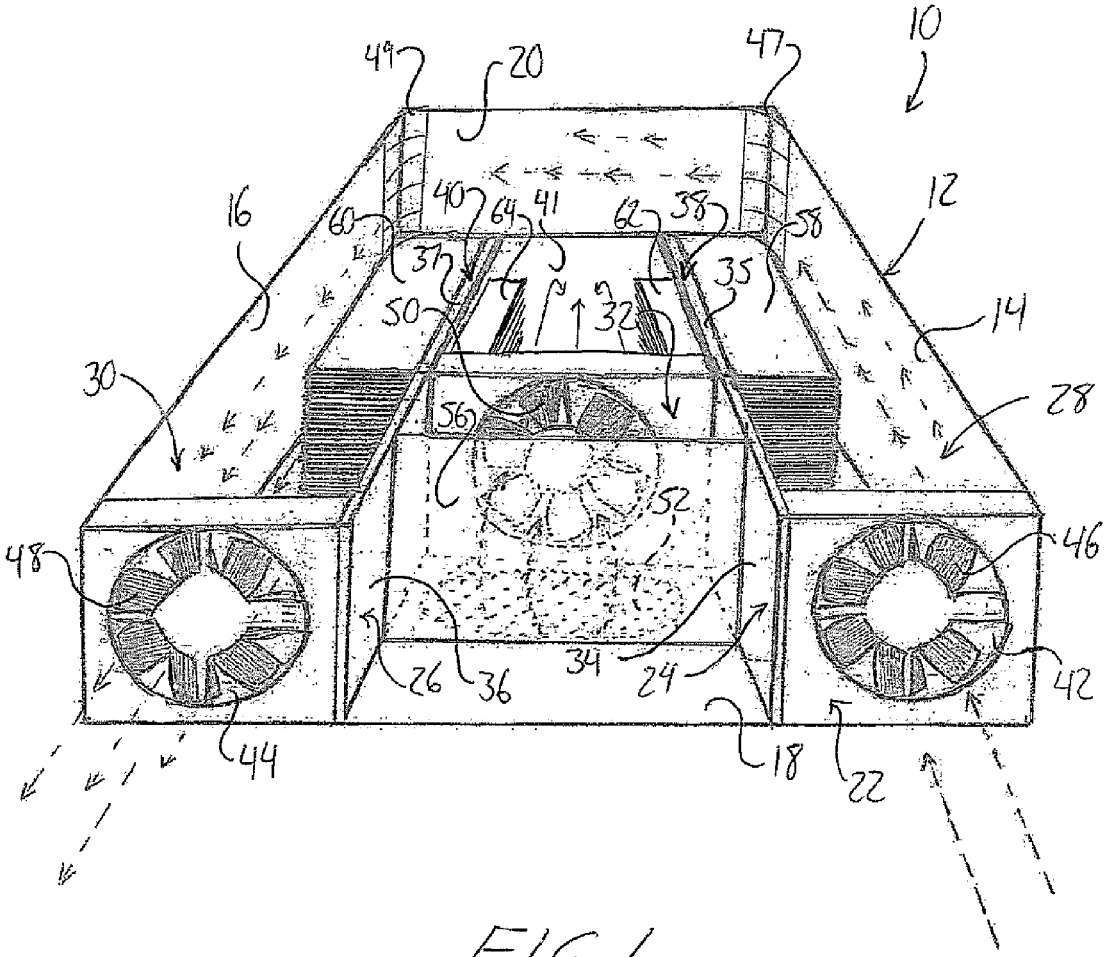
FIG. 1 is a schematic perspective view of a first embodiment self-contained cooling system module of the present invention in which two thermoelectric cooling assemblies share a common cold side airflow channel and utilize interconnected hot side airflow channels to draw heat away from the two thermoelectric cooling assemblies using a common stream of air that enters and exits the cooling module at a single end thereof.

FIG. 1 is a schematic perspective view of a cooling module 10 according to a first embodiment of the present invention with a top cover and electronic control assembly removed for illustrative purposes. The cooling module 10 features a housing 12 having a pair of opposed planar rectangular side wall panels 14, 16 projecting vertically upward from a planar rectangular bottom panel 18 along two sides thereof. A planar rectangular rear end face 20 projects vertically upward from the bottom panel 18 to perpendicularly interconnect the side wall panels 14, 16 at one end of the housing. A planar rectangular front end face 22 projects vertically upward from the bottom panel 18 to perpendicularly extend between the side wall panels 14, 16 at the opposite end of the housing, but is shown incomplete in the figures as a central section of the front end face is to be completed by installation of an electronic control module having a display face spanning between the shown portions of the front end face 22 and presenting an electronic display, for example for displaying temperature control information to the owner/operator of the cooling system. Electronic controls and displays for thermoelectric cooling systems, such as those used for cooled wine cabinets, are well known and thus not described herein in detail. Although also not shown, a planar rectangular top cover panel of equal size to the bottom panel 18 completes the housing by closing off the top thereof between the side walls 14, 16 and the end faces 20, 22.

Inward from the first and second side walls 14, 16 are first and second planar boundaries 24, 26 that divide a front portion of the housing interior bounded by the side walls, end faces and top and bottom panels into three parallel channels extending parallel to the side walls 14, 16. A first outer channel 28 is situated between the first side wall 14 and the first boundary 24, a second outer channel 30 is situated between the second side wall 16 and the second boundary 26, and an inner channel 32 is situated between the two boundaries 24, 26. At front end portion of the inner channel 32 adjacent the front face 22 of the housing 12, the boundaries 24, 26 dividing the housing interior into the three channels are defined by first and second planar wall panels 34, 36 extending from the front face 22 toward the rear face 20. From ends of the first and second boundary wall panels 34, 36 opposite the front end face 22, thermoelectric modules 35, 37 of first and second thermoelectric cooling assemblies 38, 40 are coplanar with the boundary wall panels 34, 36 and extending therefrom further toward the rear wall panel 20. The hot side face of the first thermoelectric cooling assembly 38 faces into the first outer channel 28 and the hot side face of the second thermoelectric cooling assembly 40 faces into the second outer channel 30. The cold side face of each thermoelectric cooling assembly 38, 40 faces into the center channel 32.

In the first embodiment, the center channel 32 does not extend fully to the rear wall panel 20 as the thermoelectric cooling assemblies 38, 40 stop short thereof and define rear ends of the boundaries 24, 26 that separate the adjacent channels from one another. However, the outer channels 28, 30 do extend the full length of the housing 12 from front end face 22 to the rear end face 20. The center channel 32 is closed off at its end nearest the rear end face 20 of the housing 12 by a center channel rear end wall 41 spanning between the rear ends of the boundaries 24, 26 and the space between this vertical rear end wall 41 of the center channel 32 and the rear end face 20 of the housing 12 is left open. The two outer channels 28, 30 thus fluidly communicate with one another around the closed rear end of the of the center channel 32 to cooperate with the empty space between the center channel 32 and the rear end face panel 20 to thereby collectively define a generally U-shaped perimeter passage extending along the side and rear wall panels from the portion of the front end face 22 defining the front end of the first outer channel 28 to the portion of the front end face 22 defining the front end of the second outer channel 30, these portions of the front end face having inlet openings 42 and outlet openings 44 formed respectively therein.

A hot side inlet fan 46 is mounted within the first outer channel 28 just inside the front end face 22 and is operable to draw air through the inlet openings 42 in the front end face 22 at this front end of the first outer channel 28 from outside the housing 12 into the first outer channel 28 inside the housing 12. A hot side exhaust or discharge fan 48 is mounted within the second outer channel 30 just inside the front end face 22 and is operable to force air from the second outer channel 30 inside the housing 12 to the outside environment through the outlet openings 44 in the front end face 22 at this front end of the second outer channel 30. The two hot side fans thus cause ambient air from the outside environment to flow into the first outer channel 28 of the housing 12 toward the rear end thereof, around the rear end of the center channel 32 into the second outer channel 30, and onward therealong to then exit the housing through the outlet openings 44 for return to the outside environment. As this flow of air passes by the hot side of each of the thermoelectric cooling assemblies 38, 40, heat is transferred from the hot side to the airflow for subsequent discharge from the housing 12. First and second rear corners 47, 49 at the connection of the rear end face panel 20 to the first and second side wall panels 14, 16 respectively may be internally radiused, as schematically shown at 47 and 49, to provide an smoother flow of air around the closed off center channel 32 as it passes through the interconnected outer channels 28, 30.

A cold side fan 50 is mounted in the center channel 32 at a front end of the two thermoelectric cooling assemblies 38, 40. Between this cold side fan 50 and the front face 22 of the housing, inlet openings 52 are defined in the bottom panel 18 of the housing 12 inside the center channel 32. Under operation of the cold side fan 50, air from beneath the housing 12 is drawn into the center channel 32 through these inlet openings 52 and moves past the fan 50 toward the rear wall 41 of the center channel 32. Adjacent the rear wall 41 of the center channel 32 on the same side thereof as the cold side fan 50, outlet openings 54 (schematically shown in FIG. 3 for another embodiment) are defined in the bottom panel 18 of the housing 12 inside the center channel 32. With the cold side fan driven to draw air into the center channel 32 past this fan 50, the air continues onward along the center channel 32 toward the rear wall thereof, transferring heat from the air to the cold sides of the two thermoelectric cooling assemblies 38, 40 to effect cooling of the air as it moves therealong, and finally exiting the housing 12 through the outlet openings in the bottom of the center channel 32.

A vertical front end wall 56 of the center channel 32 spans perpendicularly between the boundary wall panels 34, 36 adjacent the center channel inlet openings 52 on the same side thereof as the front end face 22 of the housing 12. This separates the space between the center channel front end wall 56 and the front end face 22 of the housing 12 from the rest of the center channel 32 so that any electronic control components mounted within this space to control operation of the fans and thermoelectric cooling assemblies are not exposed to the air entering the housing through the center channel inlet openings 52. The first and second thermoelectric cooling assemblies 38, 40 feature first and second hot side heat sinks 58, 60 applied to the hot side faces of their thermoelectric modules inside first and second outer channels 28, 30 respectively to improve heat transfer with the air passing therethrough. Likewise, first and second cold side sinks 62, 64 are applied to the cold side faces of the first and second thermoelectric cooling assemblies 38, 40 respectively inside the central channel 32 to improve heat transfer from the air passing therethrough.

The above arrangement provides the cold side inlet and outlet openings 52, 54 in the bottom of the housing, making it useful for mounting of the cooling module 10 at the top of the interior of a cabinet enclosure for cooling of the cabinet interior from above. Alternatively, these openings could be provided in the top of the housing for use of the cooling module at the bottom of such an enclosure. Having the hot side inlet and outlet openings 42, 44 in the same front end face of the housing gives it a front intake and front exhaust configuration, so that a cabinet enclosure in which the cooling module is mounted can be placed up against a wall or other surface since no space is needed at the rear for exhaust of the air used to draw heat from the hot sides of the thermoelectric cooling assemblies. A further possibility is seating or mounting of the housing in an orientation laying one of its sides in a downward facing orientation to have the cooling module installed along a vertical side of a cabinet or enclosure to be cooled with the cold side inlet and outlet openings facing into the space to be cooled. Accordingly, the terms top, bottom front, rear and side as use in the claims appended hereto are intended to distinguish relative positions among features in three dimensions, and are not intended to limit the scope of the present invention to only devices where the features described with these terms occupy these positions in an absolute sense when in use.

While these air inlet and outlet configurations were also provided by the cooling modules of the Applicant's aforementioned patent, the cooling module of the present invention improves upon these by providing for use of multiple thermoelectric cooling assemblies sharing a common cold side channel or flow passage to provide increased cooling capacity with less increase in size than would be expected using conventional cooling system constructions.

Figure 2:
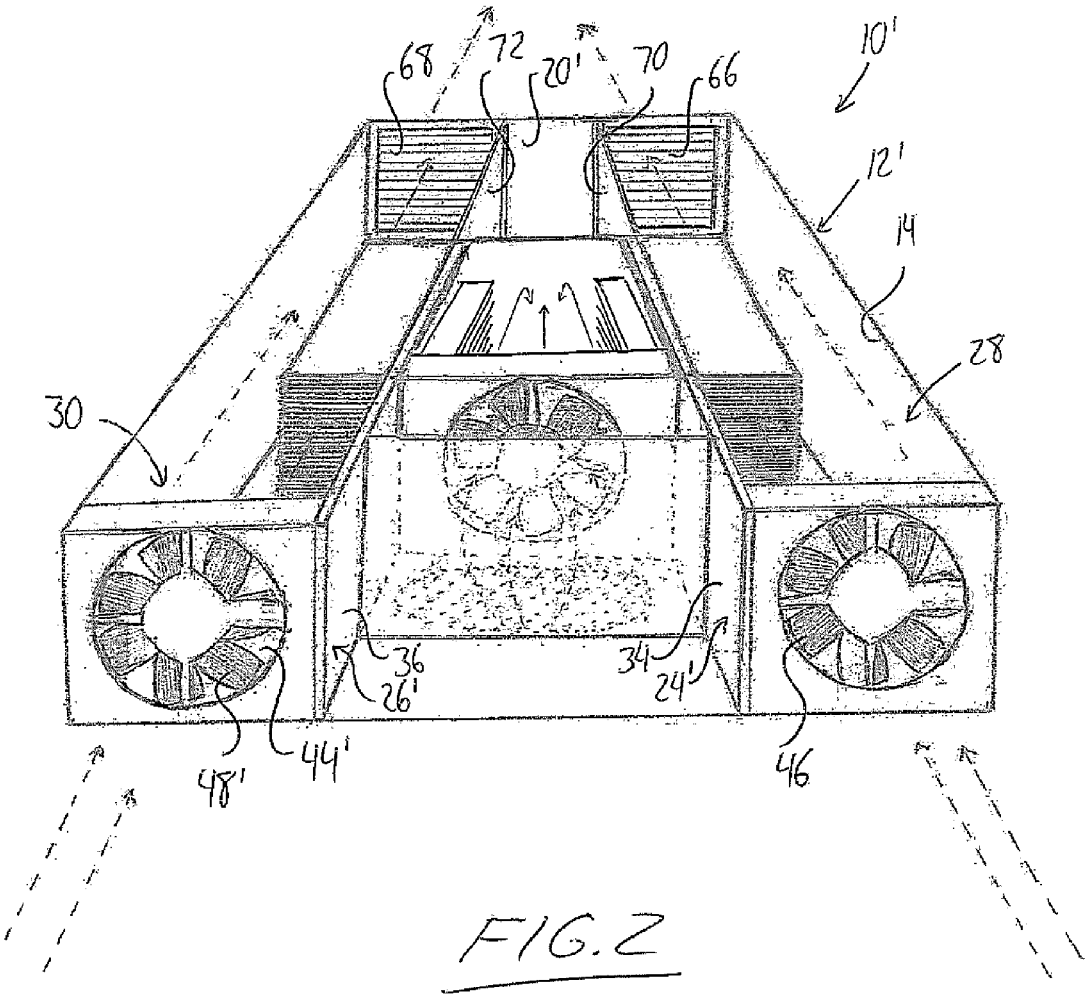
FIG. 2 is a schematic perspective view of a second embodiment self-contained cooling system module of the present invention in which two thermoelectric cooling assemblies share a common cold side airflow channel and utilize separate respective hot side airflow channels to draw heat away from the two thermoelectric cooling assemblies using separate streams of air that each enter and exit the cooling system module at opposing ends thereof.

FIG. 2 shows a second embodiment cooling module that differs from the first embodiment in that the first and second outer channels 28, 30 are not interconnected, but instead are closed off from one another to fluidly isolate each channel from the other two channels. This is achieved by extending the channel boundary walls 24', 26' from the rear ends of the thermoelectric cooling assemblies 38, 40 fully to the rear end panel 20' of the housing 12'. The rear panel 20' of the housing differs in that it contains first and second outlet openings 66, 68 formed therein at the first and second outer channels 28, 30 respectively. The hot side inlet fan 46 of the first embodiment remains the same, but the hot side exhaust fan is replaced with a second hot side inlet fan 48' operable to draw air into the second outer channel 30 through the front end face 22 rather then exhaust air from the housing at this face. Therefore, the openings 44' in the front end face 22 of the housing at the second outside channel 30 now define second air inlet openings. As a result, each of the two outer channels 28, 30 defines a respective hot side airflow passage separate from that of the other channel. Ambient air is drawn into each channel through the front end face 22, pushed or forced past or through the hot side heat sink 58, 60 of the respective thermoelectric cooling assembly 38, 40 and exhausted or expelled from the housing 12' through the outlet openings 66, 68 in the rear end panel 20'.

This second embodiment is useful for contexts where front inlet and front exhaust for cooling of the thermoelectric cooling assemblies' hot sides is not required, and benefits from the same concept of using a single cold side flow channel or passage for the two thermoelectric cooling assemblies in order to use the interior space of the housing 12' efficiently and accordingly keep down the overall size of the cooling module 10'.

A third embodiment, not shown, is adaptable to selectively take on the configuration of either of the two preceding embodiments. The first and second boundary extension walls 70, 72 of the second embodiment that extend from the first and second thermoelectric cooling assemblies 38, 40 to the rear end panel 20' to separate the two outer channels 28, 30 are arranged for removable mounting in the third embodiment to give the user control over whether to remove these extension walls to interconnect the outer channels or install the walls to make the outer channels closed off from one another. When the outer channels are connected by removing the extension walls, the outlet openings 66, 68 of the second embodiment's rear end panel 20' are closed off, for example by fitting removable covers thereover or replacing the entire second embodiment rear end panel 20' with the first embodiment rear end panel 20 having no openings therein so as to close off the rear end of the housing. Pivotal or removable mounting of the extension panels 70, 72 could allow use the same panels to selectively open and close the connection between the outer channels 28, 30 and accordingly close and open the outlet openings 66, 68 in the rear panel 20'.

Since the airflow direction through the second outer channel 30 will need to change depending on whether the cooling module is to be used in the first embodiment connected-outer-channels configuration or second embodiment separate-outer-channels configuration, the hot side fan in the second outer channel is preferably installed in such a way as to be reversible. For example, a housing of the fan may be carried on a vertical pivot perpendicular positioned centrally across the second outer channel 30 so as to be rotatable through 180° in one direction to point the fan in a direction opposite that it was previously facing, and selectively back through that same 180° to its original orientation, thereby allowing selective reversing of the fan's airflow direction. A releasable snap fit or friction fit may lock the pivotal fan in either of its two possible orientations until it is next desirable to reverse the airflow direction. Alternatively, the fan housing, which defines the portion of the front end face spanning the respective outer channel in the illustrated embodiments, could be removable and reinsertable in an opposite orientation to give selective control over its airflow direction. Multiple electrical contact sets provided on the fan housing or the cooling module housing could be configured to mate with one electrical contact set on the other to facilitate electrical powering of the fan in both orientations. An alternate option is to use a fan with electrical leads of sufficient length to allow reversal of the fan as needed while maintaining the necessary electrical connection.

Alternatively, if the hot side inlet fan 46 in the first outer channel is operable to provide sufficient airflow for cooling of both thermoelectric cooling assemblies 38, 40 in the connected-channel configuration, the second fan 48' may instead be removed when converting the cooling module into this configuration. Where the housing of this fan 48' defines the portion of the front end face at the second outer channel, a removable front face plate with outlet openings therein may be mounted in place of the fan housing. Alternatively, the fan housing may be insertable and removable behind a front end plate permanently installed at the front end of the second outer channel and including suitable openings therein to act as inlet or outlet openings depending on the configuration in which the cooling module is being used.

Considering each thermoelectric cooling assembly to comprise a hot side sink, a cold side sink and at least one thermoelectric module sandwiched therebetween and considering the combination of the two thermoelectric cooling assemblies placed with their cold sides facing together to provide an airflow path therebetween as a thermoelectric engine of the cooling system, one will appreciate that such a thermoelectric engine may make use of more than one single thermoelectric module within the thermoelectric cooling assembly on each side the airflow path. That is, one could place two or more thermoelectric modules on each side of the path so that the cold sides of the two or more thermoelectric modules on one side face toward the two or more thermoelectric modules on the other side. A single cold side sink and single hot side heat sink could span the multiple thermoelectric modules on each side of the engine. The thermoelectric engine could also be produced separate from the housing in which it is to be used, allowing production of identical thermoelectric engines that can be adopted into different cooling systems or devices.

For example, again considering each pairing of a hot side heat sink and a cold side sink together with one or more thermoelectric modules therebetween to be all or part of a single thermoelectric cooling assembly, a dual cooler assembly thermoelectric engine could feature two thermoelectric cooling assemblies 38, 40 coupled together with their cold sinks facing toward one another. As demonstrated by the self contained cooling system modules of FIGS. 1 and 2, the cooler assemblies may be parallel, coupled perpendicularly together at one end by the housing of a cold side fan extending between the facing-together cold side sinks and coupled perpendicularly together at an opposite end by an end wall panel also extending between these cold side sinks.

Figure 3:
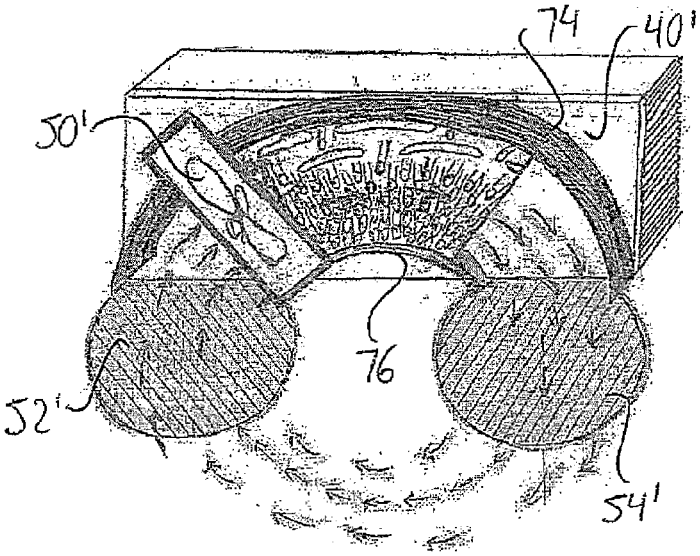
FIG. 3 is a schematic illustration of an alternate embodiment cold side airflow channel of a third embodiment self contained cooling system module of the present invention.
Figure 4:
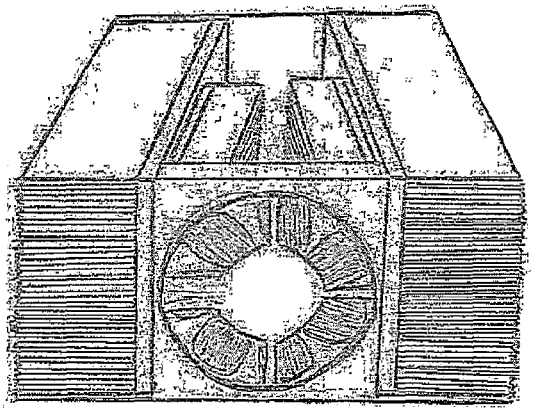
FIG. 4 is a schematic perspective view of a dual sink assembly thermoelectric engine according to the present invention.

FIG. 4 shows such a dual cooler assembly, or double sided, thermoelectric engine prior to installation within a cooling system housing. The cooling capacity requirements may determine suitable dimensions of sink assemblies and fans, and thereby the overall engine size. Engine banks permit placement of more than one (multiple) engines within one SCCS enclosure casing. Engines may be banked side by side, or end to end in such pattern than the SCCS cooling capacity is increased, with the option of front or rear exhaust features. The heat exchangers, provided by finned sinks in all the illustrated embodiments except that of FIG. 3, may be constructed from any or all readily available thermoelectric cooler (TEC) components, including but not limited to, aluminum sinks, heat pipe/cold pipe, liquid cooling, etc.

Figure 5:
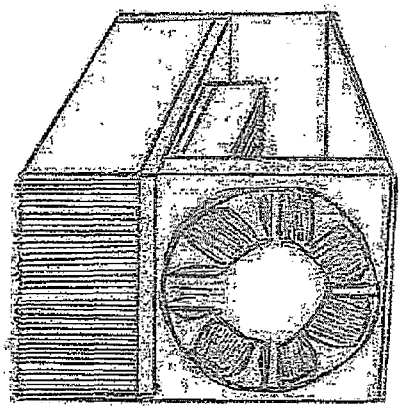
FIG. 5 is a schematic perspective view of a single sink assembly thermoelectric engine according to the present invention.
Figure 6:
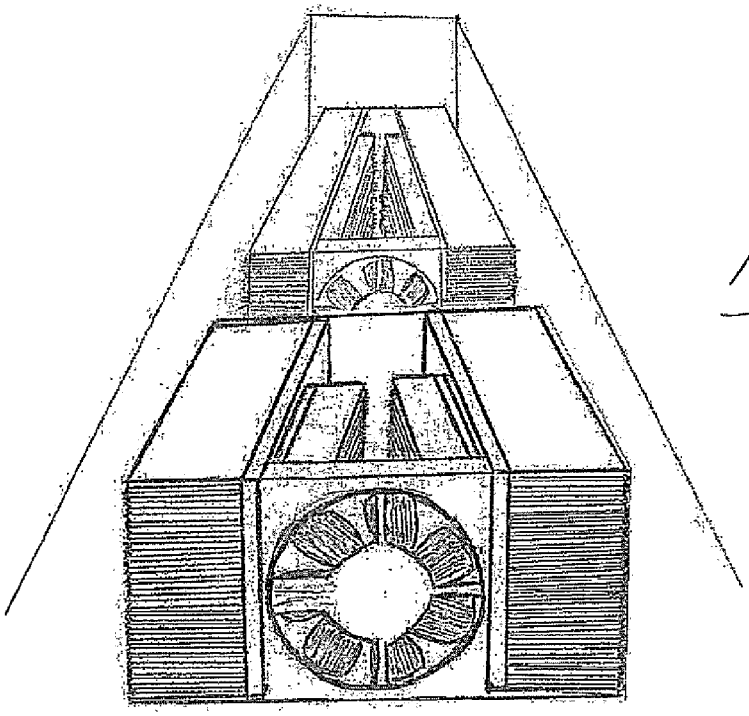
FIG. 6 is a schematic perspective view of dual sink assembly thermoelectric engines banked end to end in an enclosure.
Figure 7:
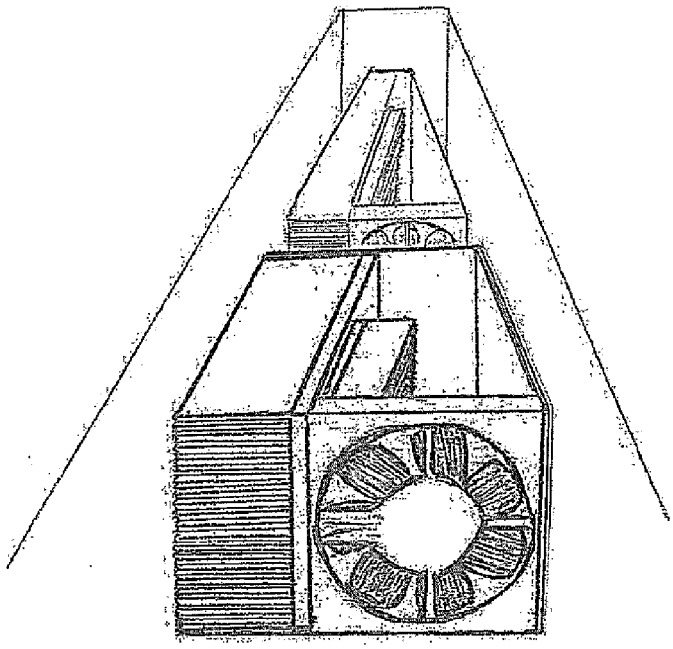
FIG. 7 is a schematic perspective view of single sink assembly thermoelectric engines banked end to end in an enclosure.

Single cooler assembly thermoelectric engines could also be produced for other applications, featuring one thermoelectric cooling assembly, with either one thermoelectric module or a series of coplanar thermoelectric modules having their cold sides facing a common direction and their hot sides facing an opposite direction, with a cold side sink and a hot side heat sink fixed respectively to the hot side(s) and cold side(s) of the thermoelectric module(s) respectively, with a cold side fan having its housing fixed to the thermoelectric cooling assembly to project away therefrom on the cold side thereof to blow air over and through the cold side sink when powered for rotation about the fan axis parallel to the thermoelectric cooling assembly on the cold side thereof. FIG. 5 shows such a single cooler assembly, or single sided, thermoelectric engine, where the side of the engine opposite the cold side sink is closed by a side wall projecting from the cold side fan to the cold side end wall in a plane parallel to the thermoelectric cooling assembly. The single engine design provides the smallest footprint Multiple thermoelectric engines of the present invention may be banked, placed or arrayed in different configurations to produce cooling systems for different context requiring different levels of cooling of different inlet and exhaust configurations. For example, engines can be mounted end to end in alignment with one another with their same side hot side heat sinks in a common channel, or in dedicated individual channels, sealed off from their cold side airflow passages, each of which has dedicated inlet and outlet openings in the cooling system housing to cooperate with the engine's cold side fan to form a respective cold air loop at that particular engine. Such arrangements are demonstrated by FIGS. 6 and 7 for double and single sided thermoelectric engines respectively, where banked thermoelectric engines are shown within cooling system housings that are only schematically illustrated and accordingly lack housing details separating the housing interior into the sealed off hot and cold side channels or passages. Engines could also be mounted side by side with adjacent hot side heat sinks optionally sharing a common hot side airflow channel or passage within the cooling system housing. FIG. 6 shows double twin sink TEC engines banked end to end, for which front and rear exhaust designs are possible, while FIG. 7 shows double single sink TEC engines banked end to end, which allow use in smaller/narrower cabinet applications.

FIG. 3 shows a schematic cross section of a dual cooler assembly thermoelectric engine of a third embodiment self contained cooling module. As described above, the dual cooler assembly features two thermoelectric cooling assemblies having their cold side sinks facing together, but only one thermoelectric cooling assembly is visible in the figure due to the cross section being taken in a plane parallel to and between the two thermoelectric cooling assemblies. A pair of concentrically curved airflow guide members 74, 76 span from the thermoelectric cooling assembly 40' on one side of the engine to the thermoelectric cooling assembly on the other side of the engine and curve about an axis normal to the parallel thermoelectric modules on the opposite sides. This thermoelectric engine is to be positioned over cold side center channel inlet and outlet openings 52', 54' in the cooling module housing so that these openings are situated adjacent opposite ends of the thermoelectric engine. The outer or larger airflow guide member 74 curves from a corner at one end of the thermoelectric engine to the corner at the opposite end but on the same side. The inner or small airflow guide member 76 generally follows the outer guide member at uniform spacing therefrom so that the airflow guide members cooperate with the thermoelectric cooling assemblies between which they span to define and airflow shroud smoothly curving from the cold side inlet openings 52' of the housing to the cold side outlet openings 54' thereof to provide smooth airflow between the cold sides of the opposing thermoelectric modules. In this embodiment, the cold side sink 64' is preferably pin fin sink to allow air to flow generally along the curving path of the shroud interior through the pins. To maximize the area of the cold side sink within the shroud, the pin array of the sink may not be rectangular, and may instead curve along the shroud interior. The cold space between the dual hot sinks is encapsulated with the shroud and the fan is installed to force/circulate air through the cold sinks then downward through the exhaust opening or grill, whereby the fan draws the same air back up through the intake grille forming a cold air loop. As shown, the cold side fan 50' may mounted inside the shroud to drive the cold side airflow loop.

It will be appreciated that the space efficient arrangement of a cooling system having multiple thermoelectric cooling assemblies sharing a common cold side airflow channel or passage may be used outside the context of cooling modules slidable into cabinets or enclosures to provide cooling of their interior. For example, the cooling system may be incorporated into a wine cooler cabinet to form an integral cooling system thereof, where the housing of the cooling system is defined by or supported by the walls or other framework of the cabinet. Furthermore, the cooling system may be used for other applications outside the context of wine cooling. The cooling system can be used in any of several applications where cooling or refrigeration is required, including cooled medicine or makeup cabinets, and its space efficient configuration may be especially well suited for mobile applications, such as use in marine or recreational vehicles.

Figure 8:
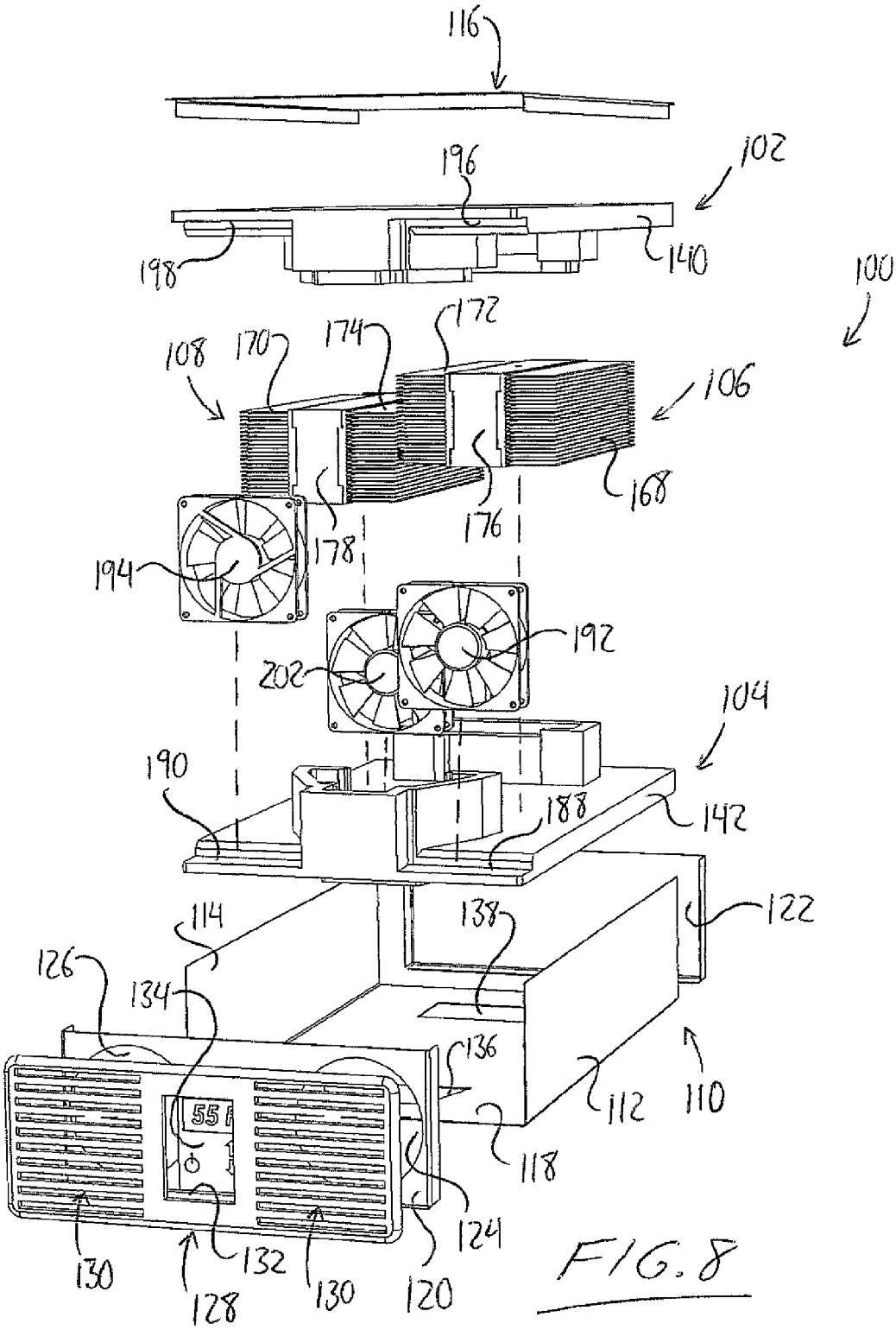
FIG. 8 is an exploded perspective view of a fourth embodiment self contained cooling system module of the present invention in which top and bottom insulation pieces mate together with thermoelectric assemblies and fans sandwiched between them, the insulation cooperating with the thermoelectric assemblies to define the boundary walls between the channels and frictionally holding the thermoelectric assemblies and fans in place in fastener-free configurations allowing tool-less removal thereof.

Turning to FIG. 8, a fourth embodiment self-contained cooling system (SCCS) 100 again configured as a stand-alone unit or module that can be added to an enclosure or cabinet of separate and distinct construction from the unit is similar in general layout and airflow pattern to the first embodiment of FIG. 1 when assembled, but features a number of differences in its construction. Most notably, this embodiment uses two insulation pieces 102, 104 profiled to cover respective ones of the top and bottom panels and present matable wall portions that extend toward one another to fit together and close around thermoelectric assemblies 106, 108 positioned between the two insulation pieces to form the boundary walls between the hot side and cold side airflow channels. Except at where each thermoelectric module resides, each boundary wall between adjacent channels may therefore be formed entirely of a thermally insulative or non-conductive material to minimize undesirable heat transfer between the hot and cold side airflows. Spanning the surface areas of the top and bottom panels of the housing, the insulation also minimizes heat transfer through these panels, which are the largest components of the illustrated housing and thus present a significant percentage of the housing's overall external surface area. Furthermore, the sandwiching or clamping of each thermoelectric assembly between the two opposing pieces of insulation, and likewise sandwiching each fan between the pieces of insulation, provides fastener-free frictional securing of these components in place. Accordingly, any of these electrical components can be removed without requiring the use of tools to free it from its respective seat or position in the housing interior.

The housing 110 of the fourth embodiment, like the other embodiments, features opposing side walls 112, 114, opposing top and bottom panels 116, 118 and opposing end faces 120, 122 cooperating to delimit a rectangular volume of interior space. In the drawings, the bottom panel 118 is integral with the side walls 112, 114 perpendicular thereto, for example by forming these by bending of a unitary sheet of metal. These parts of the housing are thus permanently fixed to one another, while the top panel 116 and front and rear end faces 120, 122 are each selectively removable from the integral parts of the housing, to allow access to the housing interior for purposes set out herein below. The front end face panel 120 fully spans the front of the housing and features a circular hole adjacent each of the panel to provide the inlet and outlet openings 124, 126 at the front of the unit for the interconnected hot side airflow channels. A front grille piece 128 fits over the front end face 120 and at each end features a series of parallel slits 130 forming a grille cover over a respective one of the hot side inlet and outlet openings 124, 126 in the front face panel 120. A central opening 132 in the grille piece 128 is provided for viewing of and interaction with a user interface of a control module 134 mounted to the exterior of the front face panel 120 at a central position therealong for control of the cooling functionality of the unit through operation of the electrical components (i.e. thermoelectric assemblies and fans). The bottom panel 118 features a cold side inlet opening 136 proximate but spaced from the front end thereof and a cold side outlet opening 138 proximate but spaced inward from the rear end.

Figure 9A:
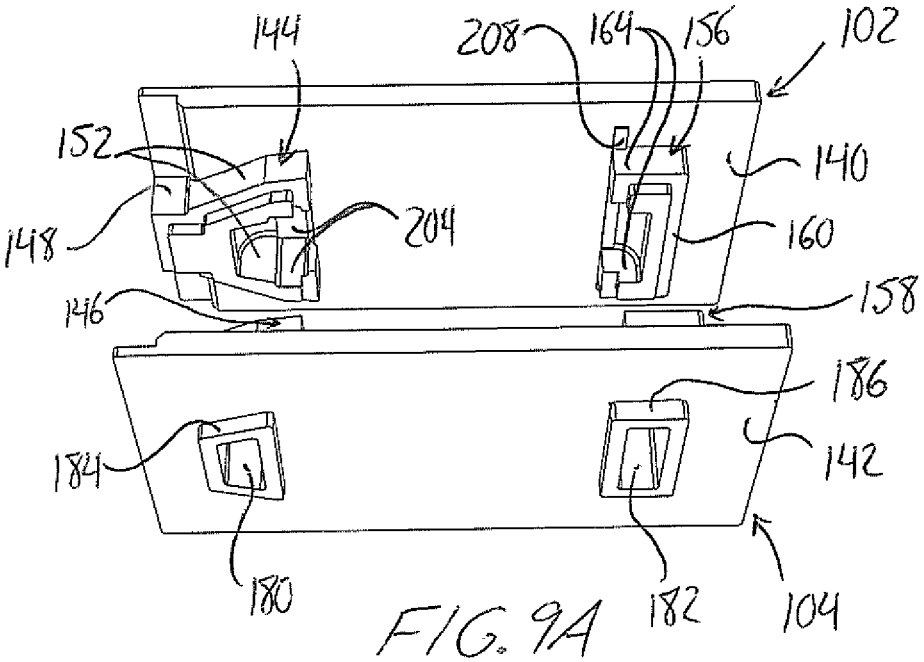
FIGS. 9A and 9B are perspective exploded views of the insulation pieces of FIG. 8 from below and above respectively to illustrate the mating together thereof.
Figure 9B:
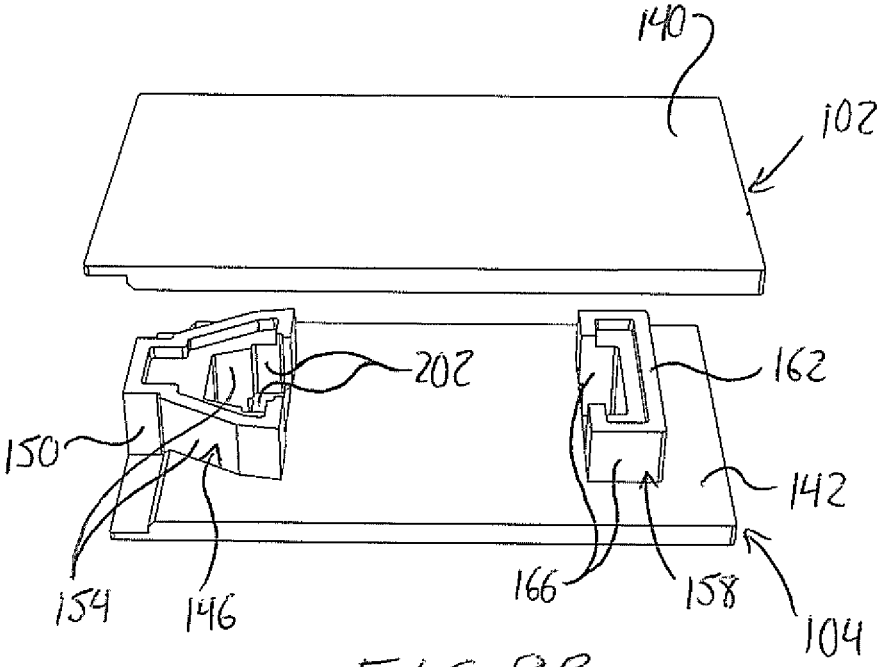

With respect to FIGS. 9A and 9B, the top and bottom insulation pieces 102, 104 each feature a rectangular base portion 140, 142 dimensioned to substantially overlie or underlie the full interior surface area of the respective one of the top and bottom housing panels 116, 118.

At the front end of each insulation piece 102, 104, a Y-shaped wall portion 144, 146 projects perpendicularly away from the side of the rectangular base facing the other insulation piece toward that other piece. A stem 148, 150 of the Y-shape on each insulation piece has a width spanning a partial length of the base portion's front edge, which corresponds to the distance by which the two hot side airflow channels are separated along the front of the unit. The branches 152, 154 of each Y-shape diverging from the stem 148, 150 extend inwardly over the rectangular base portion 140, 142 at oblique angles to the lengthwise side edges thereof.

At a distance inward from the rear end of each insulation piece 102, 104, a squared U-shape wall portion 156, 158 projects perpendicularly away from the side of the rectangular base facing the other insulation piece toward that other piece. A base 160, 162 of the U-shape on each insulation piece has a width spanning a partial length of the base portion's rear edge, which corresponds to the outer width of the cold side airflow channel at the widthwise center of the unit between the two outer hot side airflow channels extending along the sides thereof. The parallel legs 164, 166 of each U-shaped wall projecting parallel from the base 160, 162 extend inwardly over the rectangular base portion 140, 142 at angles parallel to the lengthwise side edges thereof.

As best shown in FIGS. 9A and 9B, the rectangular bases of the two insulation pieces are of equal surface area in the parallel planes of these rectangles and the position of the Y-shaped walls align with one another over this area, as do the U-shaped walls. Each wall is profiled at its distal end opposite the respective rectangular base portion to have a stepped configuration moving from an outer side of the wall to an inner side thereof. In the illustrated embodiment, the projecting walls 144, 156 of the top insulation piece 102 are stepped to increase in height moving from their outer sides to their inner sides, while the projecting walls 146, 158 of the bottom insulation piece 104 are stepped to decrease in height moving from their outer sides to their inner sides. The shape and dimensions of the steps are such that at the stepped distal ends of the walls, the taller portion of each wall will fit against the shorter portion of the correspondingly shaped wall on the other insulation piece. In the illustrated embodiment, the taller inner portions of the top piece's Y-shaped and U-shaped walls 144, 156 will seat within the recesses formed by the shorter inner portions of the bottom piece's Y-shaped and U-shaped walls. With the insulation pieces fitted together in this mating fashion to fit flush and snug against one another at these walls, the cooperation between the recessed or shorter portion of each wall with a projecting or taller portion of the corresponding wall on the other insulation pieces provides overlap of the walls in directions passing through the different wall sections. This provides improved thermal resistance and improved vapor seal over a configuration in which the insulation pieces instead fit face-to-face at only coplanar locations. The cooperation of projecting and recess portions in the walls projecting toward another also provides positive location of the insulation pieces relative to one another during placement thereof together to ensure they are properly aligned.

Figure 10:
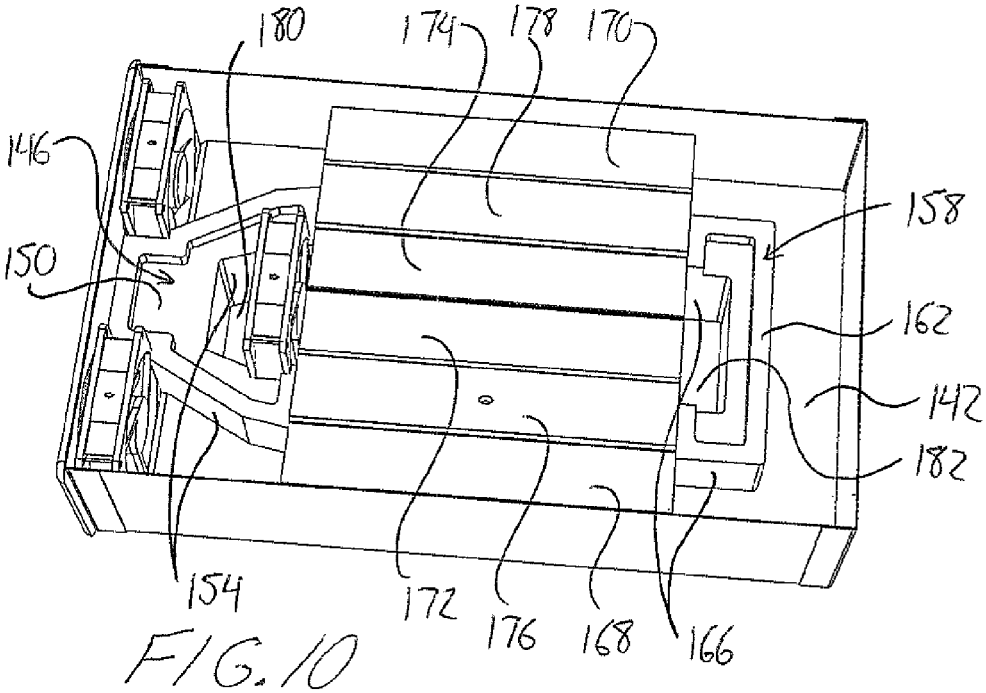
FIG. 10 is an assembled overhead perspective view of the self contained cooling system module of FIG. 8 with a top panel of its housing and the corresponding top insulation piece omitted.

Referring to FIG. 10, a flat end of each branch 152, 154 of each Y-shaped wall 144, 146 (only one of which is shown in this Figure due to removal of the top insulation piece to show the interior of the cooling unit) is parallel to the ends of the rectangular housing, as is a respective flat end of each leg 164, 166 of each U-shaped wall 156, 158. Each leg of each U-shaped wall 156, 158 aligns with the end of the corresponding branch of the Y-shaped wall on the same insulation piece, and the distance between the flat ends of these aligned wall sections equals the length of a respective one of the thermoelectric assemblies 106, 108. Accordingly, in assembly of the unit, the bottom insulation piece 104 is seated atop the bottom panel 118 of the housing, and each thermoelectric assembly is then placed atop the rectangular base 142 of the bottom insulation piece 104 to fit snugly between the flat ends of the aligned sections of the Y and U-shaped walls of the bottom piece nearest a respective side wall 112, 144 of the housing with the sinks of the thermoelectric assembly projecting away from the now-occupied space between the aligned wall sections on opposite sides thereof. The hot side heat sink 168, 170 of each thermoelectric assembly 106, 108 projects toward the nearest side wall 112, 114 of the housing, and the cold side sink 172, 174 projects away from the nearest side wall toward the widthwise center of the housing.

The thermoelectric assemblies 106, 108 of this embodiment each feature a central block of insulation material 176, 178 disposed between the sink-type hot and cold side sink-type heat exchangers of the assembly. The insulation block 176 defines the length of the thermoelectric assembly and is placed in alignment with the aligned wall sections of the insulation pieces to fill the space therebetween. At least one hollowed out portion of the insulation block 176, 178 forms a passage therethrough from a side of the block facing the respective side wall of the housing to an opposing side of the block facing the other side of the housing. This passage receives the thermoelectric module or chip positioned against a base of the hot side sink, and a cold block that extends from the opposite side of the module or chip to the base of the cold side sink on the opposite side of the insulation block. The assembly is fastened together by threaded fasteners engaged through the bases of the heat sinks to clamp the insulation block, and the chip/module and cold block combination between the sinks.

Referring to FIG. 10, the insulation block 176, 178 of each thermoelectric assembly has a width or thickness equal or close to the equal thickness or width of the aligned wall sections of the insulation pieces so that when the insulation block is snugly fitted in place between a pair of aligned wall sections on the bottom insulation piece, it effectively provides a thermally insulative connection therebetween. Once both thermoelectric assemblies are seated on the bottom insulation piece and fans are likewise seated thereon (at suitable positions described herein further below), the top insulation piece is then seated atop the bottom insulation at the mating profiles of the walls of the insulation pieces. The height of the insulation block of each thermoelectric assembly fills the distance left between the rectangular bases of the two insulation pieces. Accordingly, the fitted together walls of the insulation pieces cooperate with the thermoelectric assemblies to define boundary side walls between a resulting cold side center channel and hot side outer channels that are on opposite sides of the central channel and are interconnected therearound in the open space between the mated together U-shaped walls of the insulation pieces and the rear panel of the housing. The top and bottom walls or boundaries of each channel, and of the connection between the two outer channels, are defined by the rectangular base of the top and bottom insulating pieces respectively, which resists thermal transfer between the airflow channels and the top and bottom panels of the housing. The side walls of the housing define the remaining walls or boundaries of the outer channels, with the rear face panel of the housing likewise defining the remaining wall or boundary of the interconnection between the outer channels. In other embodiments, the top and bottom insulation pieces or shells 102, 104 may further include perimeter side walls that fit together along the side edges thereof to further insulate the outer sides of the outer channels at the side walls of the housing.

The fitted together walls of the insulation pieces and the thermoelectric assemblies between them not only provide thermal insulation, but also provide sealing within the interior space of the housing to prevent exchange of vapors between the hot and cold sides of the channel boundaries they define. In other words, not only do they provide thermal insulation against the exchange of energy (calories) between these hot and cold sides, but also prevent physical travel of cold vapors toward the hot side, and vice-versa. The snug fit between the walls and thermoelectric assemblies thus provide both thermal insulation and vapor seal.

Referring again to FIG. 9, the rectangular base of the top insulation piece is intact over the full area bound by its perimeter edges, in that no holes pass through the piece. The bottom insulation piece 104 however, features two through holes 180, 182 therein, each of which is bound on three sides by the three sections of a respective one of the Y-shaped 146 and U-shaped 158 walls of the lower insulation piece. Referring to FIG. 8, these through holes align with the inlet and outlet openings 136, 138 of the bottom panel 118 of the housing so that air entering the housing interior through these openings passes through the holes in the bottom insulation piece into the cold side center airflow channel bound by the mating walls of the insulation pieces and the cooperation thereof with the thermoelectric assemblies. With reference to FIG. 9A, protruding barriers 184, 186 may project normally from the bottom surface of the bottom piece's rectangular base 142 around the full perimeter of each through hole 180, 182 therein so as to pass through the inlet and outlet openings 136, 138 in the bottom panel 118 of the housing to minimize heat transfer and improve sealing between this panel of the housing and air passing therethrough into and out of the cold side airflow channel.

The insulation pieces or shells 102, 104 are not only cooperatively dimensioned relative to the thermoelectric assemblies 106, 108 for snug frictional fitting thereof between features of the fitted together insulation pieces to secure them in place without need for separate fasteners, but the insulation likewise cooperates with electrical fans in a dimensionally compatible manner to achieve similar fastener-free mounting of the fans within the housing interior. As shown in FIG. 8, the rectangular base 140, 142 of each insulation piece 102, 104 is stepped down in thickness moving toward the front edge thereof from a short distance inward from this edge on each side of the end of the Y-shaped wall 146 situated at this edge. On the lower insulation piece, the resulting thinner edge portion 188, 190 extending to the respective side wall 112, 114 of the housing on each side of the central Y-shaped wall 146 provides a fan-receiving seat, that much like the thermoelectric module seat provided by the rectangular base 142 between the projecting wall portions 146, 158 thereof, is dimensioned closely fit the width of a fan housing. A first of the fan seats 188 receives the housing or case of a first fan 192 to provide an intake fan at the front end of a first of the outer channels of the unit when assembled. A second of the fan seats 190 receives the housing or case of a second fan 194 to provide an exhaust fan at the front end of the second of the outer channels of the unit when assembled.

The resulting thinner edge portion 196, 198 of the top insulation piece extending to the respective side wall 112, 114 of the housing on each side of the central Y-shaped wall 144 receives the top end of the respective fan housing in same manner. The width by which the thinner edge portion extends into the rest of the rectangular base, which corresponds to the length by which the stem of the Y-shaped wall projects away from the front edge, closely matches the thickness of the fan so that the fan is retained in a stationary position between the step in the base thickness and the front panel of the housing. As demonstrated by another embodiment in FIG. 11, the fan accommodating recesses or seats at the front edge of the foam may alternatively have a width corresponding to the combined thickness of multiple fans where it is desirable to use more than one fan at the front of a channel.

A third fan 202 is accommodated in the embodiment of FIGS. 8 to 10 adjacent the open end of the Y-shaped wall 144, 146 of each insulation piece by aligned recesses 204, 206 extending into inner sides of the diverging branches of each Y-shaped wall and into the rectangular base of the respective insulation piece at positions just slightly spaced from the ends of branches. The third fan sits atop the recess in the bottom piece's rectangular base 142 in a position snugly held between the Y-branches 154 of the bottom piece 104. With all the fans seated on the bottom insulation piece 104, fitting of the top insulation piece 102 onto the bottom piece fits the thinner or recessed portions of the top piece's rectangular base over the top of the fan housings, with the Y-branches 152 of the top piece snuggly embracing opposite sides of the third fan housing, and so each fan is frictionally engaged in place by sandwiching thereof between the two insulation pieces. The similar sandwiching of the thermoelectric assemblies between the insulation pieces against the flat portions of the rectangular bases between the Y and U-shaped walls to snugly engage each thermoelectric assembly between these walls means that all fans and thermoelectric assemblies are frictionally secured in place within the interior of the housing on the top cover panel 116 of the housing is secured onto the side walls 112, 114 to hold the insulation pieces tight against one another at their mating interfaces.

The outer fans received in the seats at the front edge of the bottom insulation piece are easily accessible by removal of the front end face (and grill, where present), whereupon the front fans can be simply pulled out from the open space between the front edges of the two insulation pieces. The center fan received in the cold side channel between the Y-shaped walls of the insulation pieces is also easily accessed, by in a different manner; namely by instead removing the top panel of the housing and the top insulation piece therebeneath. Accordingly, not only does frictional fastener-free tool-less mounting of components ease in original assembly of the unit, but makes for easier service, maintenance, repair or re-configuration later on, as access to each components for removal thereof can be accomplished merely by removing the front panel or a combination of the top panel and top insulation piece. No loosening of fasteners or use of tools is required to separate the components from their installed positions, as they can simply be manually pulled from their frictionally held engagement with the insulation.

An additional feature of the fourth embodiment is a strip of wick material 208 (visible in FIG. 9A) that crosses the cold side airflow channel and extends therefrom into the two hot side airflow channels on opposite sides thereof. The wick absorbs moisture that is condensed from the air in the cold side airflow channel and is then drawn through the wick into the warmer hot side air flow channels through the effect of natural capillary action, where the heat present therein evaporates the moisture from the wick. The illustrated embodiment features a single wick extending along the rectangular base of the top insulation piece in a notch that cuts a short distance into the bottom of the free ends of the U-shaped wall 160. The wick installation need not be a continuous length across the cold side airflow channel and could be replaced with two separate wicks, each extending into a respective one of the hot side airflow channels. Another embodiment may feature multiple wick installations, for example one at each of the top and bottom insulation pieces. The illustrated wick is positioned near the end of the airflow channel opposite the single fan shown therein, but it will be appreciated that other positions relative to one or more fans in the cold side airflow channel could be contemplated.

Suitable wick-like materials include cotton mesh or other fiber-based mesh, but other materials having liquid absorbing and capillary properties may be employed, the selected material preferably being thermally insulative to minimize heat transfer between the hot and cold side airflow channels. Examples of possible materials for the insulation pieces include polyurethane (PU), expandable polystyrene (EPS), vacuum insulated panels (VIP) or other suitable material known to have high thermal resistance. Furthermore, insulation pieces may feature thermally radiant barriers such as foil-like metalized surfaces uniformingly covering the surfaces of the insulation pieces exposed to direct hot air to further improve thermal insulation. Sheet metal, polymeric or other material of suitable strength and rigidity may be used to construct the housing.

The illustrated insulation-shell embodiments feature Y-shaped walls at the front ends of the matable insulation pieces, which are useful for accommodating fans at the front of the outer airflow channels that are of greater size than a remainder of each such channel, but it will be appreciated that the configuration of these walls may be varied from the oblique sides of the Y-branches while still provided separation of the adjacent channels from one another. Although the illustrated fan positions sandwiched or clamped in place between the insulation pieces at the front edges thereof allows easy withdrawal of these front fans by removal of the housing's front face for withdrawal through the open space between the insulation pieces at their front edges, an alternate embodiment (not shown) may instead feature rectangular through holes in the top insulation piece through which fans can be inserted or withdrawn, either to sit atop the bottom insulation piece or to slide further into holes in the bottom piece to sit atop the bottom panel of the housing. Such openings would preferably be dimensioned for a snug fit with the fans to hold them firmly in place, and a gasket could be used at any interface between the fan housing and the housing of the unit to minimize vibration and noise. This would also provide easy access to the fans by removal of just the top panel. However, the illustrated embodiment provides advantage in that a layer of insulation is maintained between the fans and the panels of the housing to better minimize heat transfer between the top and bottom panels and the airflow channels therebetween.

With reference to FIG. 8, the rear panel 122 is preferably removable, and may be swapped for a panel of the equal or similar structure to the illustrated front panel 120 for selective re-configuration of the illustrated front exhaust unit (having an airflow path like the first embodiment of FIG. 1) into a rear exhaust unit (having an airflow path like the second embodiment of FIG. 2). That is, by replacing the solid rear panel 122 fully closing off the rear end of the housing with the two-opening front panel structure, each of the two outer channels becomes open at the rear end thereof to allow through-flow of air from front to back through these two channels. To accomplish such airflow, embodiments using one or more fans at the front of each outer channel require that the fan(s) of one of the two channels have its airflow direction reversed to change from an exhaust fan directing air out through the front opening of the channel into an intake fan drawing air into the channel through the front opening.

The friction-only mounting of fans between the insulation pieces in the illustrated embodiment allows this to be easily accomplished by removing the front panel of the housing, pulling the fan in question out from between the front edges of the insulation pieces, flipping it around through 180° to point its rotation axis in the opposite direction, and reinserting it between the insulation pieces. Accordingly, an end user or distributor of the unit can easily re-configure between front and rear exhaust arrangements by swapping one end panel for another at the rear of the unit, removing the front panel to gain access to the fan, removing the fan (without requiring tools), flipping the fan around, replacing the fan back to its original position in its new orientation, and re-mounting the front panel. The entire process may be completed without use of any tools if the front and rear panels use tool-less fastening arrangements, such as a snap fit for manually releaseable mounting on the other panels and walls. As explained above for another embodiment, other ways of allowing opening and closing of the rear ends of the outer channels may alternatively be employed to achieve the same end-result configurability.

Even in embodiments that are not re-configurable between front and rear exhaust operation (for example having a permanently-mounted and permanently-closed rear panel), the fastener-free mounting of components provides dramatically easier access to internal components that may need repair or service. For example, a thermoelectric assembly or fan in need of replacement could simply be swapped out by the end user without requiring engagement of any outside or specialized service or repair technician, especially when releasable plug-in electrical connectors are used to wire in the various electrical components to one another. A front exhaust configuration using one or more fans in only one of the outer channels can similarly be re-configured to rear exhaust by simply adding one or more fans to the other channel to blow toward the rear of that other channel. The re-configuration between front and rear exhaust may include plugging up the opening or connection between the two outer channels when switching to rear exhaust, for example using an appropriately sized additional piece of insulation material to fill the space behind the central channel without blocking the rear of the two outer channels.

Figure 11:
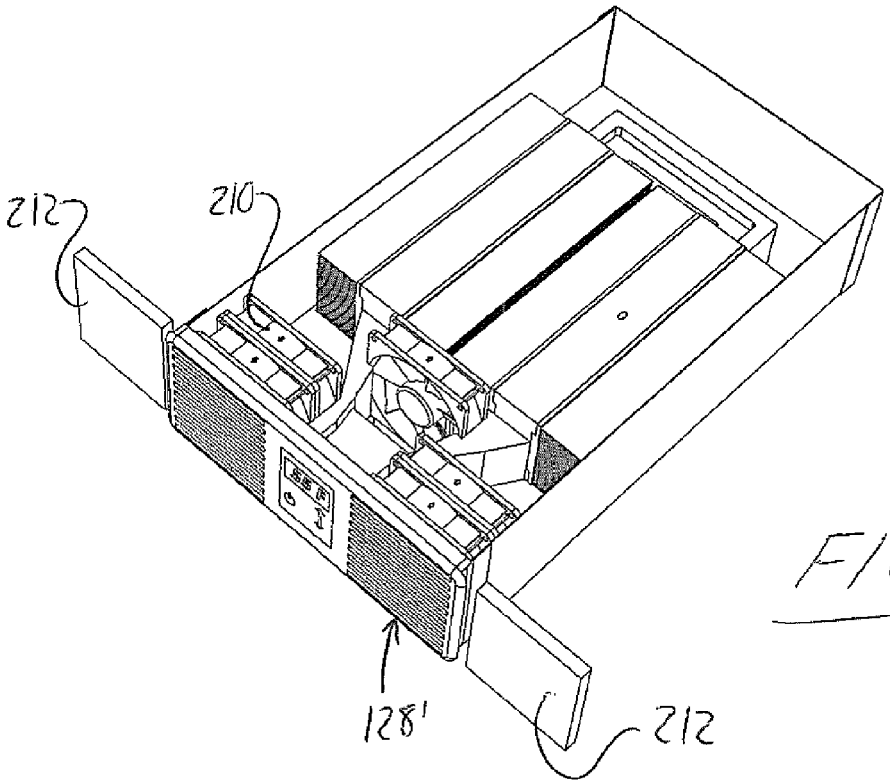
FIG. 11 is an overhead perspective view of a fifth embodiment self contained cooling system module adding additional fans at the front end to produce two dual-fan stacks for which filtering mufflers are used to reduce fan noise and filter air flowing through the unit, the filtering mufflers being shown in exploded positions and the top panel of the housing and the corresponding top insulation piece again being omitted.

FIG. 11 shows a fifth embodiment that not only illustrates how a second fan 210 can be employed at the front of one or both of the outer channels, but additionally shows the use of filtering mufflers 212 that are removably received at respective positions in front of the two openings in the front end face through slots left open between the front end panel 120 and the front grill piece 128' at opposite ends thereof. Top and bottom flanges (of which only the top is shown at 128*a*) projecting reward from the rest of the grille piece 128 along the top and bottom edges thereof are used to mount the grill piece onto the housing, but the sides of the grill piece lack any such flanges in order to leave the opening into which the filtering mufflers are slidable. The mufflers are made of a suitable air-filtering material and double in functionality by additionally muffling or dampening noise created by operation of the fans at the front of the unit. The fans are placed face to face in axial alignment with one another in a stacked configuration to increase airflow through the unit, and the filtering mufflers are selectively removable by the user for cleaning or replacement.

Figure 12:
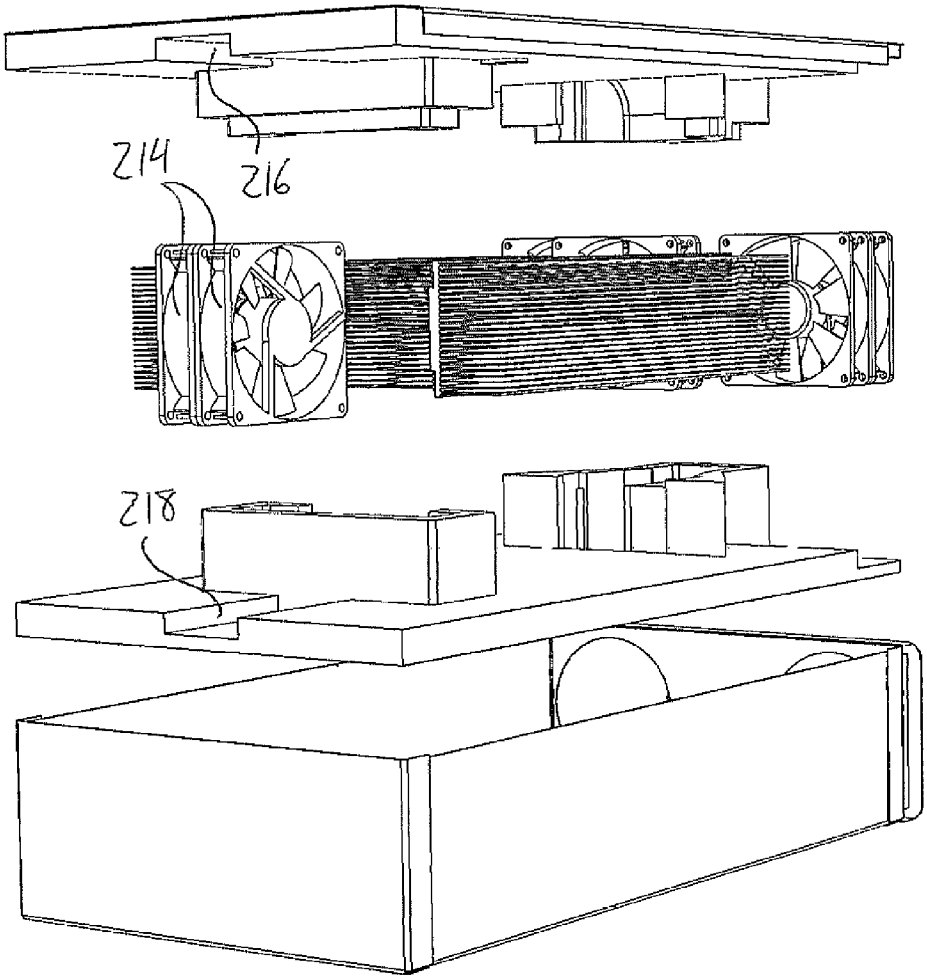
FIG. 12 is an exploded perspective view of a sixth embodiment self contained cooling system similar to the fifth embodiment, but adding rear fans disposed within an interconnection between hot side airflow channels to further promote airflow through resulting U-shaped passage extending around a central cold side airflow channel.

FIG. 12 shows a sixth embodiment similar to the fifth embodiment, but adding additional installation of two stacked fans 214 adjacent the rear of the unit to reside within the interconnection of the two outer channels around the rear end of the center cold side airflow channel. The rotational axes of these fans, and thus the direction of airflow, is perpendicular to those at the front of the unit to aid in conveyance of air from one outer channel to the other across the rear of the unit. To provide the same easy accessibility and tool-less removal of these rear fans 214, a slot 216, 218 cuts into the rectangular base 140', 142' of each of the top and bottom insulation pieces 102', 104' from the rear edge thereof over a partial thickness of the rectangular base from the side thereof facing the other insulation piece. Along the rear edge of the insulation piece 102', 104', the width of the slot 216, 218 is equal or near to the combined axial thickness of the two fans 214 to accommodate seating thereof in the slot 218 of the bottom piece and covering thereof by the top piece at the slot 216 therein. Like the reduced thickness front edges of the insulation pieces that accommodate the front fans, the slots cooperate with the exterior housing to fix the location of the fans positively located therein. The inner end of the slot furthest from the back edge of the insulation piece (which in the illustrated embodiment corresponds to the base of the U-shaped wall of the piece) and the rear panel of the housing block movement of the fans along one directional axis, the opposing sides of the slot block movement of fans along another directional axis, and the sandwiching of the fans between the insulation pieces fixes them in the third directional axis, thus maintaining the fans stationary in three dimensions. The fans in the front are similarly fixed in one direction between the front panel and the edge of the stepped fan seat, in another direction between the stem of the Y-shaped wall and the respective side walls of the housing, and in the final direction by the sandwiching between the insulation pieces. Embodiments featuring different fan seats at different locations can be re-configurable by allowing addition or removal of fans at these or other different locations within the housing interior.

With both the fans and the thermoelectric assemblies easily accessible by mere removal of one or more outer panels of the housing and the top insulation piece, the system can be easy serviced, maintained, reconfigured, customized, and scaled in performance. The insulation shells may be set up with a number of predetermined potential fan-mounting sites to give a user options on how many fans to use and where. For example, the insulation shells of the embodiment of FIG. 12 provide sufficiently sized seats for accommodating up to two fans at the front of each channel and up to two fans at the rear interconnection of the two outer channels. Other embodiments, not shown, may add an additional fan seat at the rear end of the central channel for mounting of a second central fan in that channel to draw air therethrough toward the outlet opening to further aid in airflow through the center channel. Although the illustrated embodiments make use of box fans, other embodiments may alternatively employ radial/centrifugal fans, tube axial fans, blowers, etc.

In order to configure a system best suited to the intended use, a purchaser of the system may be given the option of selecting from a number of different fan configurations, and from different thermoelectric assemblies that are each sized to fit within the accommodating areas of the insulation but have different specifications or performance capabilities. Similarly, the owner of an existing can swap out the thermoelectric assemblies for others and change the number and/or position of fans to suit use of the system in a different application or to adapt the system to change in load requirements for the same original application.

It will also be appreciated that although the above embodiments are described in terms of a cooling system in which the cold side of the thermoelectric modules face into a common airflow channel or passage between the thermoelectric modules, it will be readily appreciated by those of skill in the art that the same teachings can be applied to produce a heating system by reversing the orientation of the described thermoelectric assemblies to face the hot sides into the central channel or passage between the assemblies. As an alternative to such flipping of the thermoelectric assemblies, conversion of the unit into a heating device can instead be accomplished electrically by reversing wiring polarity, whether done by actual physical re-wiring or electronically via a control board. For example, the unit may be user-controlled for selection between heating and cooling applications via selectable options on the control board user interface.

Figure 13:
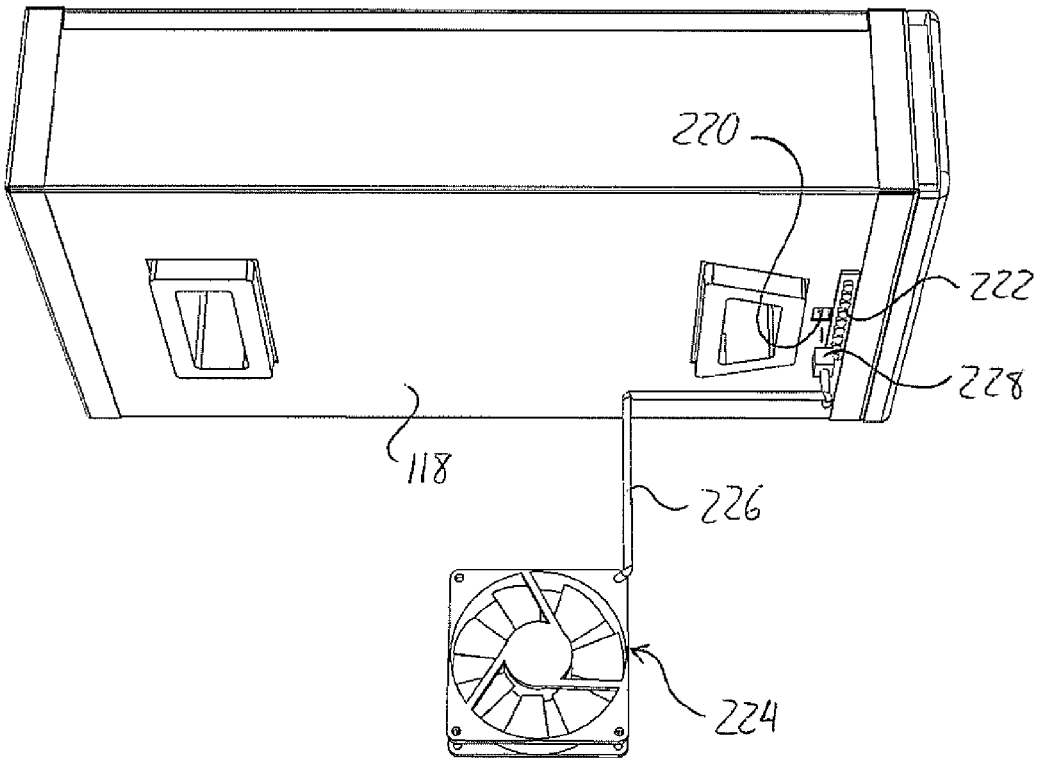
FIG. 13 is a bottom side perspective view of a seventh embodiment self contained cooling system similar to the fifth embodiment, but adding an external LED lighting bar and an external receptacle into which an auxiliary fan can be plugged for operation of the lighting bar and fan within an enclosure in which the cooling system is employed.

FIG. 13 shows a seventh embodiment that differs from the fifth only in the addition of an electrical connector receptacle 220 and an LED lighting bar 222 to the bottom panel 118 of the housing proximate the front end thereof between the cold channel inlet opening and the front end face panel.

The lighting bar or strip 222 extends along the front end of the housing and features a plurality of light emitting diodes (LEDs) spaced along the length of the strip. The lighting bar 222 is connected to the control module of the unit for user-selection or user-programmed activation and deactivation of the lighting bar for control over illuminating of a cabinet interior or other enclosure or volume of space in which the unit is used for cooling. The lighting bar is mounted to face downward from the unit at the bottom panel thereof since the intake and discharge of the cold side airflow of the illustrated embodiment are defined at the bottom panel, as this means the unit is installed over a space to be cooled and illuminated and so the downwardly cast illumination will provide light within the cooled space. An external auxiliary fan 224 features a power cable 226 that carries a plug connector 228 at the end of the cable 226 distal to the fan 224. The plug connector 228 is matable with the connector receptacle opening downward at the bottom panel of the cooling unit housing to establish connection of the fan to the control module to provide control over powering the external auxiliary fan 224.

The auxiliary fan is thus part of a selectively connectable air circulating means for added control of temperature of the space or enclosure in which the cooling unit is operating, for example for the purpose of either achieving greater uniform temperature throughout the space, or purposely creating various temperature zones throughout the system by controlling air flow in the space. The fan is remote-controlled by the unit and may be separately obtained therefrom as an optional add-on feature. Like the lighting bar, the auxiliary fan connection is provided on the same side of the unit as the intake and outlet of the cold-side airflow channel since it will be this side of the unit that is faced into the space to be cooled by the unit. In other cooling units intended for bottom or side mounting beneath or laterally adjacent the space to be cooled, the light bar and fan connection would be provided with the cold-channel openings at a top or side of the unit's in-use position to direct illumination and extension of the fan cable into the space.

It will be appreciated that a light source other than an LED strip may similarly be mounted on the housing to illuminate away therefrom to light up the space being cooled when turned on, and that the position of the light source need not necessarily be adjacent the front end of the unit. However, LED's are energy and space efficient. As disclosed in Applicant's previous aforementioned patent, the unit may use cooperable slide-components between the unit's housing and the walls of an enclosed space to be cooled in embodiments where the unit is to be installed in an overhead configuration over the space to be cooled, while alternatives would include seating the unit atop a shelf spanning over the space with the cold-channel inlet and outlet, the fan connection and the lighting bar either overlying corresponding holes in the shelf or being situated at overhanging portions of the unit behind and in front of a shelf spanning only part of the cabinet depth at an intermediate portion thereof between the cold-channel inlet and outlet openings. As disclosed in Applicant's previous aforementioned patent, different power sources and connections thereto may be employed to power the cooling units, including potential use of solar panels for environmentally friendly installations using clean renewable solar power.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A heating or cooling unit for heating or cooling an enclosure, the unit comprising:

a housing having an interior bound by opposing first and second end faces, opposing first and second side walls and opposing top and bottom panels;

three flow channels defined within an interior of the housing and consisting of first and second outer flow channels extending along the opposing first and second sides on opposite sides of a center flow channel that is closed off from the outer flow channels;

first and second thermoelectric modules supported at boundaries between the center flow channel and the first and second outer flow channels respectively with matching ones of a hot or cold side of each of the first and second thermoelectric modules facing into the first and second outer flow channels respectively and the other of the or cold side of each of the thermoelectric modules facing into the center flow channel;

center inlet and outlet openings in a same one of the top and bottom panels, the center inlet and outlet openings being situated at the center flow channel and communicating an exterior of the housing with only the center flow channel of the three flow channels; and outer inlet and outlet openings in one or opposing ones of the first and second end faces, the outer inlet and outlet openings being situated at the outer flow channels, communicating the exterior of the housing with only the outer flow channels of the three flow channels, and comprising at least first and second outer openings in the front end face at the first and second outer channels respectively.

2. The heating or cooling unit of claim 1 wherein the outer inlet and outlet openings consist only of the first and second outer openings, the first and second outer channels being interconnected around the center channel between the center channel and the rear end face.

3. The heating or cooling unit of claim 1 wherein each of the outer channels is openable and closable to the exterior of the housing at the rear end face to selectively define outer outlet openings when open at the rear end face for air flow through each end face at each channel.

4. The heating or cooling unit of claim 3 wherein each outer channel is closed at the rear end face the outer channels are interconnected with one another around the center channel for airflow into the first outer channel through the first outer opening in front end face, onward from the first channel into the second channel through interconnection of the outer channels sections around the center channel, and then out from the second outer channel through the second outer opening.

5. The heating or cooling unit of claim 3 comprising first and second outer fans installed within the first and second outer channels respectively to convey air therealong, at least one of the first and second outer fans being reversible to change a direction in which air is conveyed thereby to enable air conveyance of the first and second outer fans in a same direction with the outer channels closed to the exterior of the housing at the rear end face thereof and in opposite directions with the outer channels open to the exterior of the housing at the rear end face thereof.

6. The heating or cooling unit of claim 1 comprising internal insulation in the interior of the housing, the internal insulation cooperating with thermoelectric assemblies, which comprise the thermoelectric modules, to define the boundaries between the central channel and the outer channel and provide thermal insulation and vapor seal therebetween.

7. The heating or cooling unit of claim 1 comprising internal insulation in the interior of the housing, the internal insulation defining seats that conform in shape to thermoelectric assemblies, which comprise the thermoelectric modules, for receipt and positioning of said thermoelectric assemblies at the boundaries between the central channel and the outer channel.

8. The heating or cooling unit of claim 7 wherein the internal insulation comprises insulation pieces mated together with the thermoelectric assemblies sandwiched therebetween.

9. The heating or cooling unit of claim 7 wherein the thermoelectric assemblies are positively positioned within the interior of the housing by the module seats in a fastener-free installation of the thermoelectric modules.

10. The heating or cooling unit of claim 8 wherein the insulation pieces comprise top and bottom shell pieces mated together from above and below the thermoelectric assemblies, at least one of the top and bottom panels being removable with a respective one of the top and bottom shell pieces to access the thermoelectric assemblies.

11. The heating or cooling unit of claim 1 comprising internal insulation in the interior of the housing, the internal insulation defining at least one fan seat that conforms in shape to at least one fan and receives and positions said at least one fan in a position to convey air along at least one of the channels.

12. The heating or cooling unit of claim 11 wherein the position of each said at least one fan is accessible for retrieval thereof the interior of the housing by removal of a respective one of the walls, panels or end faces without requiring removal of any of the internal insulation.

13. The heating or cooling unit of claim 11 wherein said at least one fan seat is dimensioned to accommodate multiple box fans in an axially aligned face-to-face stacked configuration, whereby a user can add and remove fans to the fan seat as required to control air flow.

14. The heating or cooling unit of claim 1 comprising at least one wick extending from inside the central channel into at least one of the outer channels to draw moisture condensed from exposure of air to the cold side of at least one of the thermoelectric modules to an area exposed to the hot side of said thermoelectric module.

15. The heating or cooling unit of claim 1 comprising at least one fan positioned in a respective one of the one of the outer channels adjacent the front end face and at least one respective filtering muffler disposed between said at least one fan and said front end face.

16. The heating or cooling unit of claim 1 comprising:

an interconnection of the first and second outer channels around the center channel between the rear end face and the center channel; and at least one fan mounted in the interconnection of the outer channels and operable to convey air from one of said outer channels to the other.

17. The heating or cooling unit of claim 1 comprising top and bottom insulation pieces fitted together inside the interior of the housing to cooperate with thermoelectric assemblies, which comprise the thermoelectric modules, to define the boundaries between the central channel and the outer channels, the top and bottom insulation pieces at the fitting together thereof overlap in a direction crossing between adjacent channels to provide thermal insulation and a vapor seal therebetween.

18. The heating or cooling unit of claim 1 comprising an electrical connector accessible at an exterior of the housing and arranged to couple with a mating electrical connector of an auxiliary exterior fan outside the housing to enable operation of the fan within a space in which the heating or cooling unit is installed to promote flow of air within the space to increase exposure of the air to the thermoelectric assemblies.

* * * * *